United States Patent [19]

Kaufmann et al.

[11] Patent Number: 4,760,628

[45] Date of Patent: Aug. 2, 1988

[54] DRAWING-IN OF HEDDLES REMOTE FROM A LOOM HARNESS FRAME

[75] Inventors: Frank H. Kaufmann, Travelers Rest; Charles F. Kramer; James D. Grigsby, both of Greenville; Stephen J. Root, Mauldin, all of S.C.

[73] Assignee: Steel Heddle Manufacturing Corp., Greenville, S.C.

[21] Appl. No.: 907,367

[22] Filed: Sep. 15, 1986

[51] Int. Cl.[4] ..... D03J 1/00

[52] U.S. Cl. ..... 28/201; 28/208; 28/203

[58] Field of Search ..... 28/201, 208, 205, 206, 28/207, 203

[56] References Cited

U.S. PATENT DOCUMENTS

| | | | |
|---|---|---|---|
| 669,394 | 3/1901 | Keene | 28/208 |
| 750,300 | 1/1904 | Oldfield | 28/205 X |
| 1,304,846 | 5/1919 | Blair | 28/208 |
| 1,473,578 | 11/1923 | Greve | 206/388 |
| 1,694,954 | 12/1928 | Stack | 53/397 |
| 2,016,543 | 10/1935 | Cox | 28/201 |
| 2,116,570 | 5/1938 | Goldman | 206/388 |
| 3,430,313 | 3/1969 | Koch | 28/205 |
| 3,690,087 | 9/1972 | Jacobsen | 53/397 |
| 4,036,264 | 7/1977 | Kaufmann . | |
| 4,475,574 | 10/1984 | Baumann | 139/92 |
| 4,481,980 | 11/1984 | Stenhouse . | |
| 4,529,014 | 7/1985 | Rast et al. . | |
| 4,643,232 | 2/1987 | Wagner | 139/92 |

FOREIGN PATENT DOCUMENTS

| | | | |
|---|---|---|---|
| 51-35757 | 3/1976 | Japan | 28/205 |
| 354023 | 8/1931 | United Kingdom | 28/203 |
| 1098108 | 1/1968 | United Kingdom | 28/201 |

*Primary Examiner*—Robert R. Mackey
*Attorney, Agent, or Firm*—Dority & Manning

[57] ABSTRACT

Methods and means for allowing heddles to be drawn-in with warp yarns away from a loom for subsequent loading into the loom. A heddle holder allows rows of drawn-in heddles to be carried to the loom. Removable heddle rod sections allow for the heddle holder to load the rows of drawn-in heddles into intermediate portions of heddle rods of adjacent harness frames. The heddle holder also positions the adjacent harness frames during loading of the drawn-in heddles. Individual warp yarn beam canisters provided with the drawn-in heddles facilitate the heddle holder loading of the drawn-in heddles into the harness frames. A protective covering protects the drawn-in warp yarns as they are transferred from the remote drawing-in site to the loom.

8 Claims, 4 Drawing Sheets

DRAWING-IN OF HEDDLES REMOTE FROM A LOOM HARNESS FRAME

BACKGROUND OF THE INVENTION

This invention relates to a means for drawing-in warp yarns into heddles when the heddles are remote from a loom.

Generally, the drawing-in of warp yarns into heddles while the heddles are mounted in a loom harness frame is not a great problem, as long as the loom is relatively narrow. However, some looms may be as wide as thirty feet or more. On a very wide loom, there may be as many as thirty thousand warp yarns which have to be drawn in through heddles. When it becomes necessary to draw in the heddles of such a wide loom, because of a change in beams, a change in the weave, etc., the drawing-in of all of the heddles may take weeks.

During the drawing-in, the loom must be shut down, thereby causing costly production losses. It would thus be desirable to provide a means whereby the time required is reduced for providing a wide loom with drawn-in heddles.

Attempts at reducing the time required to draw in a wide loom have been made, and in one particular instance, the heddle rod of the harness frames were made up in a plurality of segments wherein the entire heddle rod could be removed one segment at a time. The drawing-in of the heddles for a particular segment took place away from the loom. The beam and the heddles would then be transported to the loom with the warp yarns already drawn-in. The drawn-in heddles would have to be interlaced between various rolls and mechanisms on the loom so that the heddles could be positioned adjacent the harness frame for insertion therein. This is a very tedious and cumbersome operation, itself oftentimes causing breakage in the warp yarns due to their engagement with various mechanisms carried on the loom. Further, the releasable fastening of the heddle rod to the harness frame slats in segments reduced the deflection strength of the harness frames as compared to the harness frames having non-segmented heddle rods riveted to the harness frame slats.

The ability to draw-in the heddles remote from the harness frame of a loom allows the heddles to be drawn-in prior to an anticipated loom shut down. Thus, when the loom is shut down, the already drawn-in heddles can be loaded in the loom harness frames much quicker than if the heddles were drawn-in while still in the loom. Having the heddles drawn-in before the loom is shut down allows for the loom to be provided with drawn-in heddles in a matter of days instead of weeks as would take if the heddles were drawn in while on the loom.

SUMMARY OF THE INVENTION

It is therefore an object of the present invention to provide both a method and a means for removing ordered groups of heddles from a loom harness frame.

Another object of the present invention is to provide both a method and a means whereby heddles can be drawn-in away from a loom.

Another object of the present invention is to provide both a method and a means for placing ordered groups of drawn-in heddles in a loom harness frame.

Another object of the present invention is to provide a heddle rod on which a group of heddles may be removed from or placed on a mid-section of a heddle rod.

Yet another object of the present invention is to provide a beam which accommodates a group of drawn-in heddles which are to be placed in a loom harness frame.

Another object of the present invention is to provide a protective covering for warp yarns being transported.

Still another object of the present invention is to provide a method and means for protecting warp yarns being transported which have been drawn-in to heddles.

Generally, the present invention includes a heddle holder for supporting heddles as the heddles are transported to and from heddle rods or bars carried in a harness frame. The heddle holder comprises: a first elongated frame member; a second elongated frame member spaced from and extending substantially parallel to the first elongated frame member; support element means spanning between and carried by the first and second elongated frame members for supporting the heddles thereon; and retention means associated with the support element means for retaining the support element means to the first and second elongated frame members.

The heddle holder supports heddles on rows of shafts extending between frame members. The shafts are inserted through an alignment hole found adjacent each end of each heddle. The heddle holder can be used to load or unload heddles from several adjacent harness frames at a time. The heddles may be supported on the heddle holder during the practice of the method of drawing-in warp threads into the heddles while the heddles are separate from a loom harness frame.

The present invention also includes an improved heddle rod attached to an edge of a harness frame slat for allowing heddles to be slidably loaded at a mid-section portion thereon. The improved heddle rod comprises a first longitudinally extending rod section rigidly fixed against the harness frame slat; a second longitudinally extending rod section rigidly fixed against the harness frame slat substantially co-linear with the first longitudinally extending rod section; the second longitudinally extending rod section being spaced apart from the first longitudinally extending rod section to define therebetween the mid-section portion on the harness frame slat of a predetermined distance; and a removable rod section having a length substantially equal to the predetermined distance releasably secured against the harness frame slat substantially co-linear with both the first and second sections, whereupon removal of the removable section from the harness frame slat, the heddles may be loaded onto the first and second rod sections from adjacent the mid-section portion of the harness frame slat.

The improved heddle rod includes a removable mid-section portion which allows heddles to be removed from or placed on a heddle rod from a mid-section portion of a harness frame slat, when the removable mid-section of the heddle rod has been taken off the harness frame. The provision of the removable mid-section portion of the heddle rod allows for the heddles to be loaded at a mid-point of a heddle rod using the heddle holder, instead of loading the heddles from the edge of the loom on the heddle rod. The removable mid-section portion of the heddle rod is held in place on the harness frame slat by a quick-release projection/slot fastener means.

Also included in the present invention is a method of drawing warp threads into individual heddles while the individual heddles are separate from a harness frame of a loom. The method comprises: positioning the individual heddles side-by-side to form a plurality of substantially parallel rows of individual heddles between a first elongated frame member and second elongated frame member of a heddle holder; inserting removable longitudinally extending shaft means through each of the plurality of substantially parallel rows of individual heddles and the first and second elongated frame members for retaining each of the plurality of substantially parallel individual heddles between the first and second elongated frame members; releasably mounting onto a drawing-in frame the heddle holder with the plurality of substantially parallel rows of individual heddles retained between the first and second elongated frame members; and drawing the warp yarns into the individual heddles while the individual heddles are retained in the plurality of substantially parallel rows between the first and second elongated frame members.

The method for attaching the heddles to a loom harness frame is practiced using the heddle holder. Notches in upper and lower frame members of the heddle holder engage the underside of heddle rods of adjacent harness frames to hold the harness frames in position as the heddles are slid onto the upper and lower heddle rods of adjacent harness frames.

Further included in the present invention is a method of attaching heddles, each heddle having an upper slot and a lower slot, to an upper heddle rod and a lower heddle rod of a harness frame. The method comprises: supporting the heddles side-by-side on a heddle holder so that the upper slot of each heddle is substantially in parallel alignment with one another and so that the lower slot of each heddle is substantially in parallel alignment with one another; removing an upper removable rod section from each upper heddle rod; removing a lower removable rod section from each lower heddle rod; positioning the heddle rod holder adjacent where the upper removable rod section was removed from each upper heddle so that the upper slots of the heddles are in substantial alignment with the upper heddle rod of each harness frame for engagement thereon; positioning the heddle rod holder adjacent where the lower removable rod section was removed from each lower heddle rod so that the lower slots of the heddles are in substantial alignment with the lower heddle rod of each harness frame for engagement thereon; moving the heddles while supported by the heddle holder so that the upper slots of the heddles engagingly attach to the upper heddle rod of the harness frame, and so that the lower slots of the heddles engagingly attach to the lower heddle rod of the harness frame; and removing the heddle holder from the heddles so that the heddles are supported by the upper and lower heddle rods.

Moreover, the present invention includes a protective covering for protecting a bundle of warp yarns being transported. The protective covering comprises: an elongated flexible sheath for encompassing the bundle of warp yarns, the elongated flexible sheath having a first longitudinally extending edge and a second longitudinally extending edge; and cooperating fastener means associated with the first and second longitudinally extending edges for fastening the first and second longitudinally extending edges together, so that when the elongated flexible sheath is received about the bundle of warp yarns, the first and second longitudinally extending edges may be fastened together by the cooperating fastener means to encase the bundle of warp yarns within the elongated flexible sheath.

The protective covering is used to protect the warp yarns, which after having been drawn-in into the heddles away from the loom, are transported from the remote drawing-in site to the loom itself. The protective covering shields the warp yarns from foreign matter, sharp edges, etc. associated with the loom which could do harm to the warp yarns if allowed contact therewith. The method for protecting the bundle of warp yarns includes wrapping the sheath of the protective covering around the warp yarns and releasably fastening the sheath together.

BRIEF DESCRIPTION OF THE DRAWINGS

The foregoing as well as other objects of the present invention will be more apparent from the following detailed description of the preferred embodiment, when taken together with the accompanying drawings, in which.

DESCRIPTION OF THE INVENTION

Figure 1:
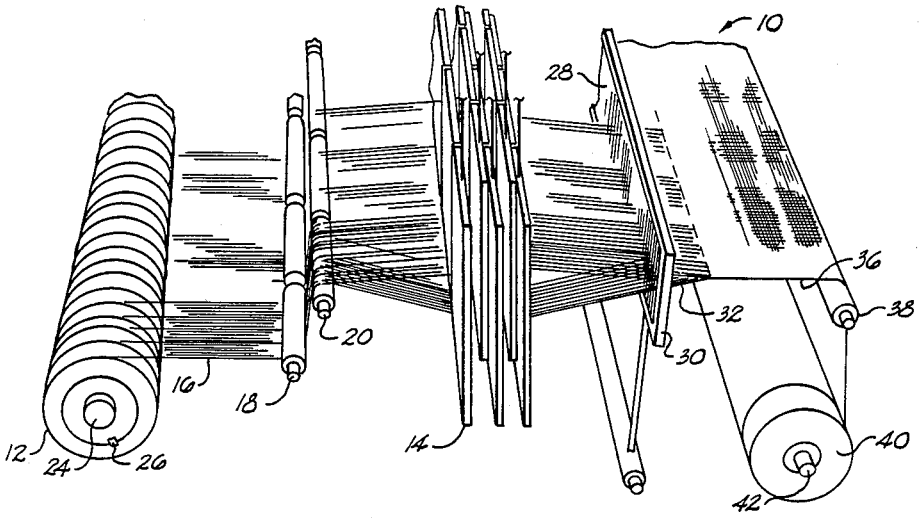
FIG. 1 is a perspective view, from the side, of a portion of a loom which has individual beam canisters.

Referring to the drawings in detail, wherein like reference characters represent like elements throughout the various views, a portion of a loom 10 is illustrated in FIG. 1. Individual beam canisters 12 supply harness frames 14 with warp yarn 16. Warp yarn 16 passes over rollers 18, 20 before reaching heddles 22 carried in harness frames 14. Beam canisters 12 are keyed to shaft 24 by key 26. After passing through heddles 22 in harness frames 14, the warp yarns 16 pass through dents 28 carried in a reed frame 30. A shuttle (not shown) carries filling yarn across the width of loom 10 inside shed 32. Shed 32 is created in warp yarns 16 by the alternate up and down movement of adjacent harness frames 14. Warp yarns 16 follow the up and down movement of harness frames 14 because warp yarns 16 are carried in eyes 34 of heddles 22. Each heddle 22 has an eye 34. Reed frame 30 moves laterally towards and away from harness frames 14 and pack the filling yarn, carried by the shuttle, into the converging portion of shed 32 or the fill to form a woven fabric 36. Woven fabric 36 then passes over roller 38 and is wound onto roll 40 carried by shaft 42.

Figure 2:
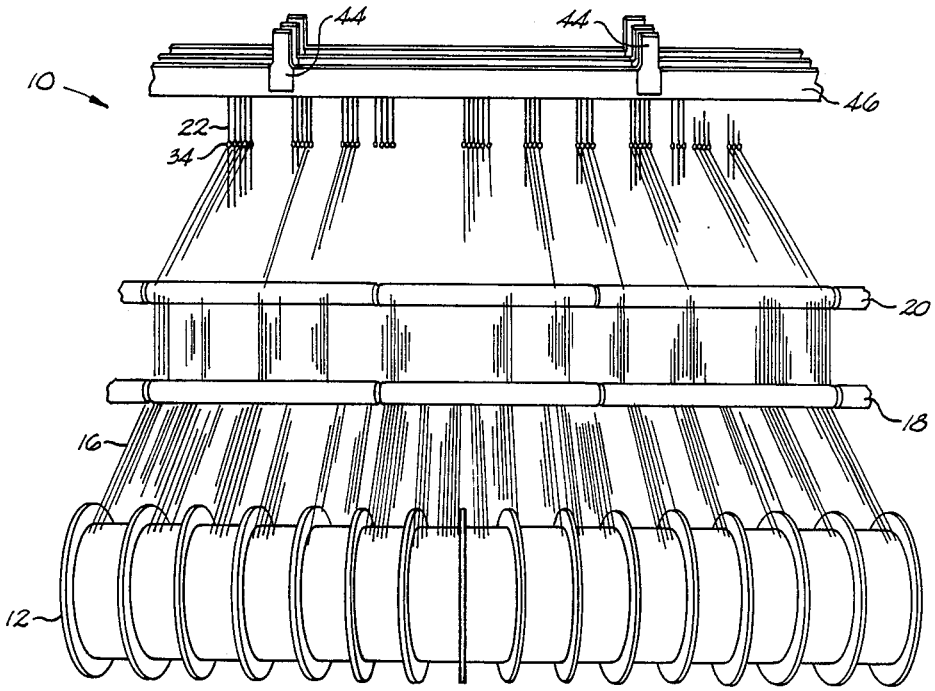
FIG. 2 is a perspective view, from the back, of a portion of a loom having individual beam canisters.

As shown in FIG. 2, beam canisters 12 are attached side-by-side to shaft 24 so that the warp yarns 16 will extend adjacent one another across the width of loom 10. Warp yarns 16 extend substantially perpendicularly from beam canisters 12 when entering eyes 34 of heddles 22. Nose guides 44 provided on harness frame slats 46 of harness frames 14 facilitate the upward and downward movement of harness frames 14 during weaving.

Figure 3:
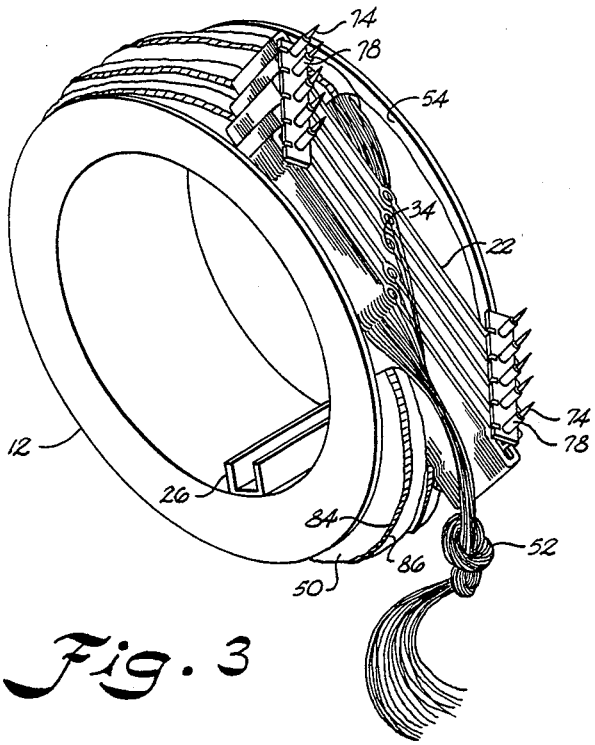
FIG. 3 is a perspective view of an individual beam canister, a protective covering for warp yarns, and a heddle holder carrying drawn-in heddles.
Figure 4:
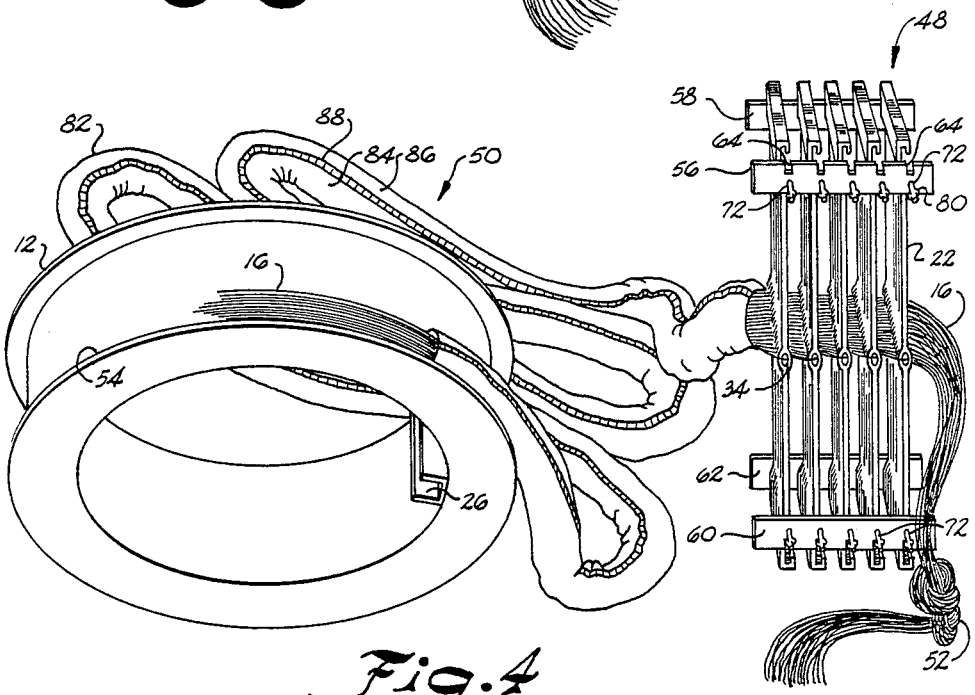
FIG. 4 is perspective view of an individual beam canister, a protective covering for warp yarns, and a heddle holder positioned for loading individual rows of drawn-in heddles onto adjacent harness frame heddle rods.

Turning now to FIGS. 3 and 4, a beam canister 12, is illustrated supplying yarns to heddles 22 carried in a heddle holder 48. A portion of the warp yarns 16 between beam canister 12 and heddles 22 in heddle holder 48 are covered by a fiber or warp yarn protective covering 50. Because heddles 22 illustrated in FIGS. 3 and 4 have already been drawn-in, knot 52 has been tied in the end of warp yarns 16 to prevent warp yarns 16 from backing out of the eyes 34 of heddles 22.

Beam canister 12 is cylindrical in shape and includes upstanding side walls 54 which serve to retain warp yarns 16 tightly wound on beam canister 12. Longitudinally extending key 26 is provided on the inner surface of beam canister 12 for engaging a longitudinally extending slot in shaft 24 of loom 10, to prevent relative rotation of beam canister 12 with respect to shaft 24. Beam canister 12 can be made of metal, plastic, or any other suitable material.

Heddle holder 48 includes two upper frame members 56, 58 and two lower frame members 60, 62. Each of the upper and lower frame members 56, 58, 60, 62 include notched-out portions 64 which engage the portion of a heddle rod or bar 66 adjacent the central opening 68 of a harness frame 14. Notched-out portions 64 serve a very useful purpose in that through their engagement with heddle rods 66 of harness frames 14, notched-out portions 64 correctly position the adjacent harness frames 14 relative to one another for subsequent loading or unloading of heddles 22 thereon or therefrom. Because harness frames 14 are relatively long and slender, and accordingly relatively flexible, notched-out portions 64 greatly facilitate fixing of the proper spacing between adjacent harness frames 14.

Transversely extending openings 70 are provided in upper and lower frame members 56, 58, 60, 62 for receiving shafts 72 which extend through openings 70 and span between upper frame members and lower frame members, respectively. Shafts 72 are provided at one end with a conical tip 74 to aid insertion of shaft 72 into alignment openings 76. At least one alignment opening 76 is provided adjacent each end of each heddle 22. A flexible sleeve 78 is placed over conical tip 74 of shaft 72 after shaft 72 has been inserted through the alignment openings 76 of a row of heddles 22 and openings 70 in the frame members. Flexible sleeves 78 serve to prevent the conical tip end of shaft 72 from backing out of the transversely extending opening 70 through which it is inserted. Flexible sleeve 78 could be made of plastic tubing, rubber tubing, or any other suitable material. The end of shaft 72 opposite conical tip 74 has an enlarged head 80 for preventing that end of shaft 72 from passing through a transversely extending opening 70.

Warp yarn protective covering 50 includes an elongated flexible sheath 82 having longitudinally extending edges 84 and 86. A cooperating fastening means such as a zipper 88 is provided for connecting longitudinally extending edges 84, 86 together after sheath 82 has been wrapped around a bundle of warp yarns 16. Warp yarn protective covering 50 serves to prevent warp yarns 16 carried therein from being exposed to foreign matter and from catching on sharp objects as the beam canister 12, heddle holder 48 and drawn-in heddles 22 carried therein are transported from a remote drawing-in site to their respective positions on loom 10. Warp yarn protective covering 50 could be made of plastic or fabric or any other suitable material. A variety of releaseable fasteners such as buttons, snaps, or the like could be used to attach longitudinally extending edges 84, 86 of sheath 82 together.

Figure 5:
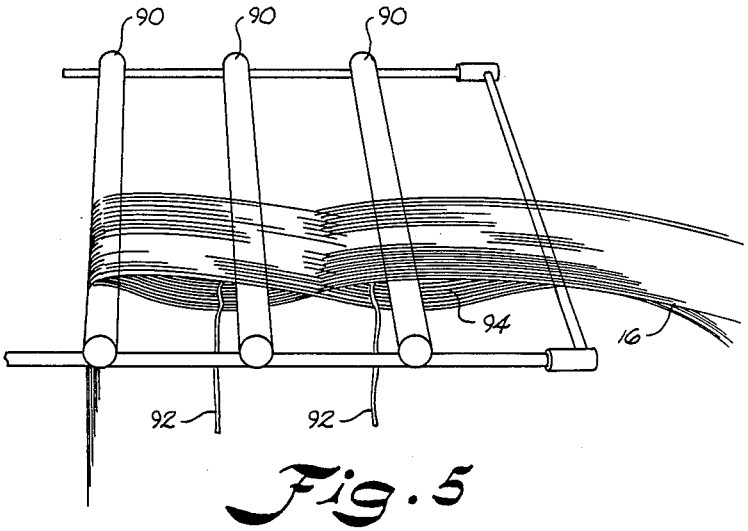
FIG. 5 is a perspective view of warp yarns alternately passing over parallel bars to form a lease.
Figure 6:
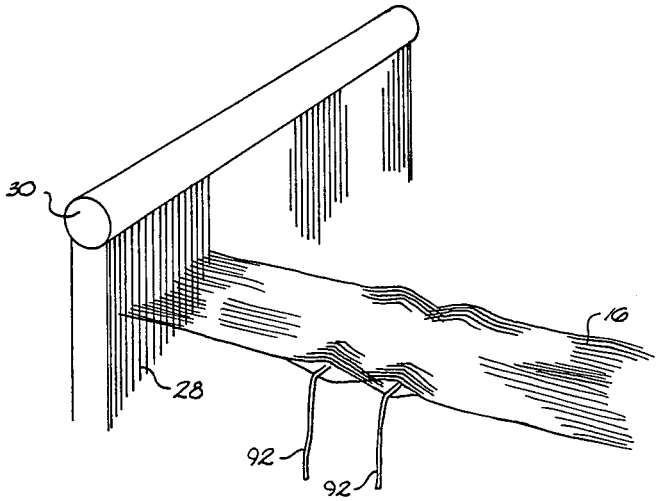
FIG. 6 is a perspective view of warp yarns, retained in a lease by transversely extending strings, passing through dents of a reed frame.

FIG. 5 illustrates warp yarns 16 being formed in a lease, which alternately separates side-by-side warp yarns 16 from one another so that they may be subsequently loaded in the proper heddles 22 of a harness frame 14. A lease is formed by alternately passing the side-by-side warp yarns 16 over and under substantially parallel extending bars 90. Strings 92 are provided in the enclosed portion 94 of the warp yarns adjacent bars 90 to retain the warp yarns 16 in the lease configuration after the warp yarns 16 has been removed from bars 90. The lease configuration of the warp yarns 16 facilitates drawing-in of the heddles 22 when the heddles 22 are side-by-side. A lease is also formed in the warp yarns 16 after they have been drawn through heddles 22 so that the alternating warp yarn configuration can be maintained as the warp yarns 16 are drawn through dents 28 and reed frame 30, as illustrated in FIG. 6.

Figure 7:
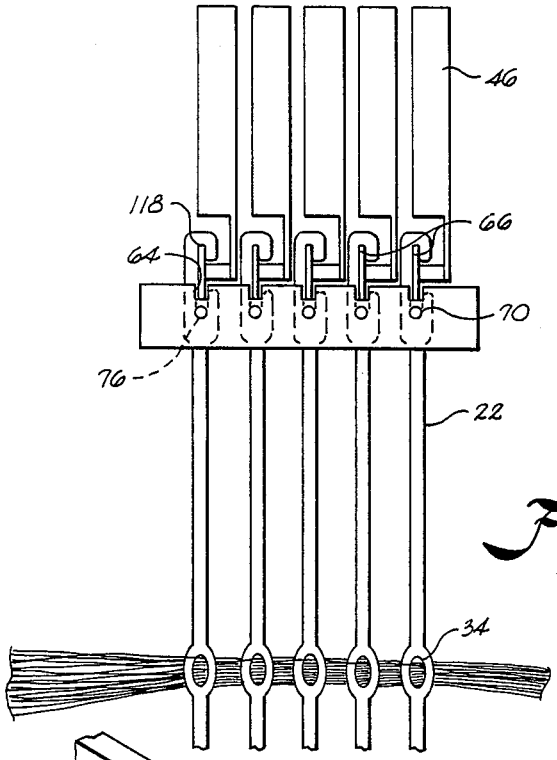
FIG. 7 is a partial side view of a heddle holder engagingly receiving heddle rods of adjacent harness frames for allowing placement of drawn-in heddles carried by the heddle holder onto the heddle rods.

FIG. 7 illustrates drawn-in heddles 22 being loaded on heddle rods 66 of adjacent harness frames 14 from heddle holder 48. Notched-out portions 64 engage a portion of heddle rods 66 adjacent the central opening 68 of harness frames 14. Although the heddles have been shown being loaded onto the upper heddle rods 66 from heddle holder 48, the drawn-in heddles are also loaded onto lower heddle rods (not shown) of harness frames 14 at the same time. For purposes of clarity, only loading of the drawn-in heddles 22 from heddle holder 48 onto the upper heddle rods 66 is illustrated.

In loading the drawn-in heddles 22 onto heddle rods 66, the upper and lower frame members 56, 58, 60, 62 slidably engage the respective upper and lower heddle rods of the harness frames 14 with notched-out portions 64. Once the rows of the drawn-in heddles 22 completely engage the upper and lower heddle rods of the harness frames 14, the flexible sleeves 78 on shafts 72 are removed, and shafts 72 are removed from transversely extending openings 70 by grasping the enlarged heads 80 of shafts 72 and pulling. By removing shafts 72 from heddle holder 48, upper and lower frame members 56, 58, 60, 62 become separate from the drawn-in heddles 22, and the drawn-in heddles 22 thus become supported by the upper and lower heddle rods of the harness frames 14.

Figure 8:
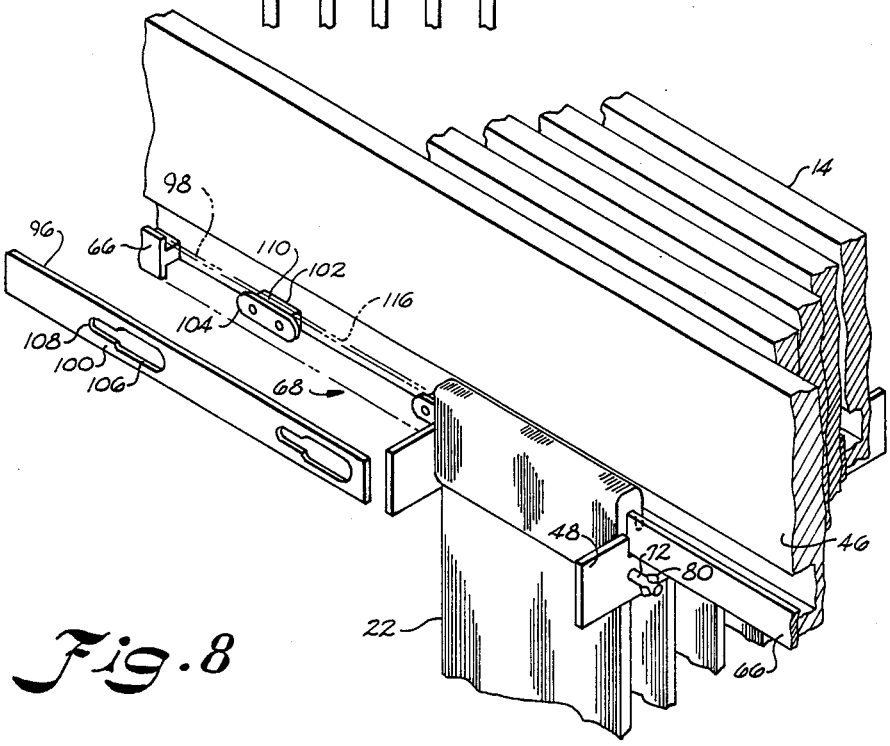
FIG. 8 is a partial perspective view of a removable mid-section portion of a heddle rod separated from a harness frame slat.

Illustrated in FIG. 8 is a heddle rod having a removable heddle rod mid-section 96 in a disconnected position. Phantom lines 98 illustrate removable heddle rod mid-section 96 in place on harness frame slat 46 of harness frame 14. Removable heddle rod mid-section 96 has two slot openings 100 which engage with projection means 102 attached to harness frame slat 46. An enlarged portion 104 of projection 102 is received by enlarged slot opening 106 when removable mid-section 96 is to be fixed to harness frame slat 46. Once enlarged slot opening 106 receives enlarged portion 104 of projection 102, removable mid-section 96 is moved longitudinally so that a narrow slot opening 108 engages a narrowed portion 110 of projection 102, thereby causing removable mid-section 96 to be securely fixed to harness frame slat 46 in substantial alignment with fixed heddle rod portions 66. Fixed heddle rod portions 66 are preferably permanently fixed to harness frame slat 46 by rivets or the like.

FIG. 8 also illustrates heddles 22 carried on heddle holder 48 being loaded onto or unloaded from heddle rod 66 through a mid-section window 116 provided when removable heddle rod mid-section 96 is removed from harness frame slat 46. The mid-section window 116 allows for heddles 22 to be loaded onto heddle rods at intermediate portions across the width of loom 10 instead of only at the edge of loom 10.

When the heddles 22 of loom 10 need to be redrawn with warp yarns 16 a portion of the heddles 22 which is equal to the yarns contained by one of the canisters 12 is separated from the remaining heddles by the heddle holder 48. The portion of the heddles to be separated and supported by the holder 48 is isolated by inserting transverse upper and lower frame members 60 and 62 along each side of the portion of the heddles with the notched out portions 64 engaging the heddle rods or bars 66, as best seen in FIG. 7. When the notched out portion 64 is engaged, the heddle bars 66 and openings 70 in the transverse frame members are aligned with the alignment openings 76 in the heddle. A support shaft 72 is inserted through openings 70 and alignment openings 76 at both the upper and lower ends of the heddles. The heddles of the portions selected are thus trapped and held firm within the parallelogram formed by transverse frame members and the support shafts, and the shafts 72 are held in place by the conical tip 74. After the portion of heddles selected are firmly secured by the holder 48 in this manner, the movable section of the heddle rod 96 is removed to open the midsection window 116. The width of window 116 is at least equal to the length of the heddles 22 selected in the portion to be removed.

After the midsection window 116 is created by the removal of the heddle rod or bar midsection 96, the heddles held by heddle holder 48 are moved longitudinally on the heddle bar supporting them into the section where window 116 is located, whereupon the heddles 22 of said portion may be removed from the heddle bar supporting them. After they are removed through window 116, the heddles are retained in their original relationship by holder 48.

The portion of the heddles 22 supported by the holder 48 can then be transported manually to a warp yarn drawing-in machine, whereupon the warp yarns for a new canister 12 are drawn through the heddles 22 in a predetermined draw-in pattern. A porotective covering 50 protects the warp yarns as they are transferred from the drawing-in site to their proper position in loom 10.

The method for drawing the warp threads into the individual heddles 22 while the individual heddles 22 are separate from loom 10 includes positioning heddles 22 side-by-side to form a plurality of substantially parallel rows. Upper and lower frame members 56, 58, 60, 62 of heddle holder 48 are placed adjacent each upper and lower end of the rows of heddles 22, and shafts 72 are inserted through the transversely extending openings 70 of the upper and lower frame members and also through all of the upper and lower alignment openings 76 of the heddles. The actual drawing-in of warp yarns 16 into the heddles can take place before or after the heddles have been positioned in heddle holder 48. Once shafts 72 have properly been inserted through heddles 22 and upper and lower frame members 56, 58, 60, 62, flexible sleeves 78 are placed on the conical tip 74 of each shaft 72 to prevent the shafts 72 from backing out from heddle holder 48.

The method for transferring the drawn-in heddles to the heddle rods 66 of the harness frames 14 includes first removing removable heddle rod midsections 96 and bringing heddle holder 48, which carries the drawn-in heddles 22, adjacent the midsection windows 116 provided by the removal of the removable heddle rod midsections 96. The heddle holder 48 is then positioned so that the notched-out portions 64 therein engage portions of the heddle rod adjacent the central opening 68 of the harness frames 14. Notched portions 64 and the upper frame members 56, 58 will engage upper heddle rod portions 66 and the notched-out portion 64 in the lower frame members 60, 62 will engage the lower heddle rod portions (not shown) of the harness frame 14. Heddle holder 48 is then slidingly advanced away from the mid-section windows 116 so that the length of the individual rows of heddles are slidingly advanced and carried adjacent fixed heddle rod portions and so that each upper heddle slot 118 and lower heddle slot (not shown) of each heddle 22 engages a respective heddle rod. Flexible sleeves 78 are removed as are shafts 72 from heddle holder 48, so that the drawn-in heddles 22 are entirely supported by the upper and lower heddle rods of harness frames 14. Removable heddle rod midsections 96 are replaced on harness frame slats 46. Adjacent fixed heddle rod portions 66 are loaded with drawn-in heddles 22 through another mid-section window 116 or from the extreme end of the heddle rod at the edge of loom 10.

Before transport of the drawn-in heddles 22 and the beam canisters 12 associated therewith to the loom 10, the bundle of warp yarn 16 extending between heddles 22 and beam canister 12 should be protected. A method for so protecting the bundle of warp yarns 16 includes wrapping the flexible sheath 82 around the warp yarns so that the two longitudinally extending edges 84, 86 are adjacent one another. The two longitudinally extending edges 84, 86 are then releasably fastened by zipper 88 or the like so that the bundle of warp yarns 16 is encased by flexible sheath 82.

Along with loading the drawn-in heddles 22 in the harness frames 14, the individual beam canisters 12 associated with the drawn-in heddles being loaded are placed on beam shaft 24 and slidingly advanced thereon to their ultimate position. Preferably, the beam canisters 12 associated with drawn-in heddles being loaded are placed on beam shaft 24 first, then the heddle holder is threaded through rollers 18, 20 and positioned adjacent mid-section windows 116.

Although the embodiment of the present invention loads five harness frames 14 at a time with drawn-in heddles 22, it is to be understood that more or less than five harness frames 14 could be loaded at one time. An advantage of the present invention is that all of the heddles 22 required for loom 10 can be drawn-in prior to a loom shutdown, thereby allowing the groups of drawn-in heddles 22 and the beam canisters 12 associated therewith to be readily placed on loom 10 when required. When loom 10 is shut down, the empty heddles are simply removed and the new drawn-in heddles 22 and beam canisters 12 are loaded into position.

While a preferred embodiment of the invention has been described using specific terms, such description is for illustrative purposes only, and it is to be understood that changes and variations may be made without departing from the spirit or scope of the following claims.

We claim:

1. A method of drawing warp yarns through the eyes of a plurality of heddles which are supported in a plurality of rows by a plurality of heddle bars on a plurality of harness frames on a loom, each of said heddles having at least two spaced alignment openings therein, said method comprising the steps of:

(a) aligning said harness frames at an intermediate point where said heddle bars are aligned;

(b) separating a portion of said heddles on each of said heddle bars;

(c) engaging said portion of said heddles with a heddle holder, which holder comprises a pair of upper and lower transverse frame members which extend transversely of said rows of heddles along each side of said portion, and further comprises inserting upper and lower support shaft means for each row of said heddles, extending longitudinally through openings in said transverse frame members and through said alignment openings in said heddles whereby said portion of said heddles are securely held by said holder;

(d) sliding said portion of said heddles off one end of said heddle bars;

(e) supporting said holder and said portion of said heddles on a warp drawing-in machine;

(f) drawing warp yarns through the eyes of said heddles from a canister of warp yarn;

(g) supporting said canister of warp yarn on said loom and sliding said portion of said heddles held by said holder onto the heddle bars of a harness frame of said loom; and (h) removing said heddle holder from engagement with said heddles, whereby drawn-in heddles and their respective warp yarn canisters are loaded on said loom.

2. The method as defined in claim 1, wherein the inserting of the longitudinally extending shaft means through each of said plurality of substantially parallel rows of individual heddles and said first and second transverse frame members includes inserting a first shaft through an upper opening carried adjacent an upper end in each of the individual heddles and inserting a second shaft through a lower opening carried adjacent a lower end in each of the individual heddles.

3. The method as defined in claim 1, further comprising:

securing said shaft means within said first and second transverse frame members of said heddle holder after insertion therein by placing a removable sleeve upon said removable shaft means opposite said plurality of substantially parallel rows of individual heddles.

4. A method of attaching heddles, each having an upper slot and a lower slot, to an upper heddle rod and a lower heddle rod of a harness frame, said method comprising:

supporting the heddles side-by-side on a heddle holder so that the upper slot of each heddle is substantially in parallel alignment with one another and so that the lower slot of each heddle is substantially in parallel alignment with one another;

removing an upper removable rod section from the upper heddle rod;

removing a lower removable rod section substantially opposite said upper removable rod section from the lower heddle rod;

positioning the heddle rod holder adjacent where said upper removable rod section was removed from said upper heddle rod so that the upper slots of the heddles are in substantial alignment with the upper heddle rod for engagement thereon;

positioning the heddle rod holder adjacent where said lower removable section was removed from the lower heddle rod so that the lower slots of the heddles are in substantial alignment with the lower heddle rod for engagement thereon;

moving the heddles while supported by the heddle holder so that the upper slots of the heddles slide into the upper heddle rod and the lower slots of the heddles slide into the lower heddle rod; and removing said heddle holder from the heddles so that the heddles are supported by the upper and lower heddle rod.

5. The method as defined in claim 4, further comprising:

drawing warp threads into the heddles while the heddles are supported by said heddle holder.

6. The method as defined in claim 4, further comprising:

replacing said upper and lower removable rod sections after the heddles have been attached to the upper and lower heddle rods.

7. The method as defined in claim 4, further comprising:

holding a harness frame slat of the harness frame in a predetermined heddle receiving position with respect to the heddles on the heddle holder by engaging at least one of the upper and lower heddle rods of the harness frame with a notched portion defined in said heddle holder.

8. A method of attaching rows of heddles, each heddle having an upper slot and a lower slot, to an upper heddle rod and a lower heddle rod of each of a plurality of side-by-side harness frames, said method comprising:

supporting the heddles side-by-side in a plurality of rows on a heddle holder so that the upper slot of each heddle is substantially in parallel alignment with one another within each of said plurality of rows and so that the lower slot of each heddle is substantially in parallel alignment with one another within each of said plurality of rows;

removing an upper removable rod section from each upper heddle rod;

removing a lower removable section from each lower heddle rod;

positioning the heddle rod holder adjacent where said upper removable rod section was removed from each said upper heddle rod so that the upper slots of each row of heddles are in substantial alignment with the upper heddle rod of each said harness frame;

positioning the heddle rod holder adjacent where said lower removable section was removed from each said lower heddle rod so that the lower slots of each row of heddles are in substantial alignment with the lower heddle rod of each said harness frame;

holding the plurality of harness frames substantially parallel to one another in a predetermined heddle receiving position with respect to the rows of heddles on the heddle holder by engaging at least one of the upper and lower heddle rods of each harness frame with spaced notched portions defined in said heddle holder;

moving each of the rows of heddles while supported by the heddle holder so that the upper slots of each row of heddles engagingly attach to the upper heddle rod of a harness frame and so that the lower slots of each row of heddles engagingly attach to the lower heddle rod of a harness frame; and removing said heddle holder from the heddles so that the heddles are supported by the upper and lower heddle rod.

* * * * *